US011077991B2

(12) United States Patent
Smith et al.

(10) Patent No.: US 11,077,991 B2
(45) Date of Patent: Aug. 3, 2021

(54) CONTAINER HAVING A TAMPER EVIDENCE TAB

(71) Applicant: Pinnpack Packaging, LLC, Oxnard, CA (US)

(72) Inventors: Shannon Smith, Oxnard, CA (US); Dean Brown, Oxanard, CA (US)

(73) Assignee: Pinnpack Packaging, LLC, Oxnard, CA (US)

( * ) Notice: Subject to any disclaimer, the term of this patent is extended or adjusted under 35 U.S.C. 154(b) by 0 days.

(21) Appl. No.: 16/546,291

(22) Filed: Aug. 20, 2019

(65) Prior Publication Data

US 2020/0062461 A1 Feb. 27, 2020

Related U.S. Application Data

(60) Provisional application No. 62/720,962, filed on Aug. 22, 2018.

(51) Int. Cl.
*B65D 43/02* (2006.01)

(52) U.S. Cl.
CPC ..... *B65D 43/0206* (2013.01); *B65D 2401/35* (2020.05); *B65D 2543/00194* (2013.01); *B65D 2543/00296* (2013.01)

(58) Field of Classification Search
CPC ..... B65D 43/0206; B65D 43/0204; B65D 43/0202; B65D 43/02; B65D 43/162; B65D 43/16; B65D 43/164
USPC ..... 220/270, 266, 265, 837, 839, 836, 810
See application file for complete search history.

(56) References Cited

U.S. PATENT DOCUMENTS 5,040,695 A * 8/1991 Adams ..... B65D 43/162 220/270
5,897,011 A * 4/1999 Brilliant ..... B65D 43/162 220/4.23
5,938,068 A * 8/1999 Atkins ..... B65D 75/22 220/266
8,360,262 B2 * 1/2013 Vovan ..... B65D 43/162 220/522
2006/0289549 A1 * 12/2006 Vovan ..... B65D 43/0254 220/791
2008/0308557 A1 * 12/2008 Kyle ..... B65D 43/162 220/359.1
2009/0090712 A1 * 4/2009 Vovan ..... B65D 43/021 220/23.86
2010/0102074 A1 * 4/2010 Parikh ..... B65D 41/32 220/810
2010/0140267 A1 * 6/2010 Sellari ..... B65D 43/0241 220/270
2015/0175315 A1 * 6/2015 Parikh ..... B65D 43/164 220/270
2019/0185221 A1 * 6/2019 Allers ..... B65D 43/0256

* cited by examiner

*Primary Examiner* — Robert J Hicks
(74) *Attorney, Agent, or Firm* — Michael R. Shevlin

(57) ABSTRACT

A tamper-resistant container with tamper evident feature which includes a base and lid joined by a flexible hinge having a tamper evident tab. The base and a lid are hingedly connected to each other via a hinge part and so interlocked form-locking latched that in the closed state. The hinge consists of a flat in the open state of the package, in which a substantially U-shaped tab separating lines of weakness to the outer edge of the flat area.

14 Claims, 6 Drawing Sheets

CONTAINER HAVING A TAMPER EVIDENCE TAB

CROSS REFERENCE TO RELATED APPLICATIONS

This application claims priority from U.S. Provisional Patent Application No. 62/720,962, filed on Aug. 22, 2018, the contents of which are incorporated herein by reference.

FIELD

The present invention relates to containers and packaging, and more particularly, to containers and packaging that incorporate tamper-resistant and tamper-evident features.

BACKGROUND

Containers for packaging, distributing, displaying or otherwise housing food items are known in the industry. The containers typically include a base and removable lid. Consumers visually inspect the containers prior to purchase to make sure that items are not damaged or missing. The lid must be capable of properly and effectively sealing the container, yet the container must be constructed so that the lid is relatively easy to remove, and even replace, since it is expected that the container and lid would normally be reused.

It would be desirable to develop a container having a tamper feature to visually show if the container had been opened.

SUMMARY OF THE INVENTION

Embodiments described herein may meet one or more of the needs identified above and may overcome one or more of the shortcomings of current containers. Various implementations of systems, methods, and devices within the scope of the appended claims each have several aspects, no single one of which is solely responsible for the desirable attributes described herein. Without limiting the scope of the appended claims, some prominent features are described herein.

In one aspect of the present invention, a tamper-resistant container is disclosed having a base; a lid coupled to the base, a flexible hinge with a line of weakness connecting the lid and the base, the flexible hinge having a tamper evidence tab position in a downward direction coupled to the line of weakness, wherein pulling the tamper evidence tab separates the hinge along the lines of weakness showing evidence of tampering.

In some embodiments, separating the hinge along the lines of weakness results in separation of the lid from the base.

In some embodiments, the base includes upright side walls, rear wall and front wall and a bottom forming a cavity.

In some embodiments, the base includes a base edge, and the lid includes a lid edge being configured to couple with the base edge in a closed position.

In some embodiments, the flexible hinge consists of a flat area in the open position.

In some embodiments, the tamper evidence tab is a substantially U-shaped tab positioned in the downward position coupled with lines of weakness from the tab to outer edges of the flat area.

In some embodiments, the downward position of the tamper evidence tab allows opening of the packaging by pulling the tamper evidence tab away from the package.

In some embodiments, the hinge is preferably formed integrally with both base and lid such that the base and lid are a single continuous piece of material formed simultaneously.

In some embodiments, the hinge is proximate a rear wall.

In some embodiments, the lid edge sits below the base edge so that the lid cannot be opened using the lid edge.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE DRAWINGS

The present embodiments may be understood from the following detailed description when read in conjunction with the accompanying figures. It is emphasized that the various features of the figures are not necessarily to scale. On the contrary, the dimensions of the various features may be arbitrarily expanded or reduced for clarity.

DETAILED DESCRIPTION

Embodiments of the invention will now be described with reference to the figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Figure 1:
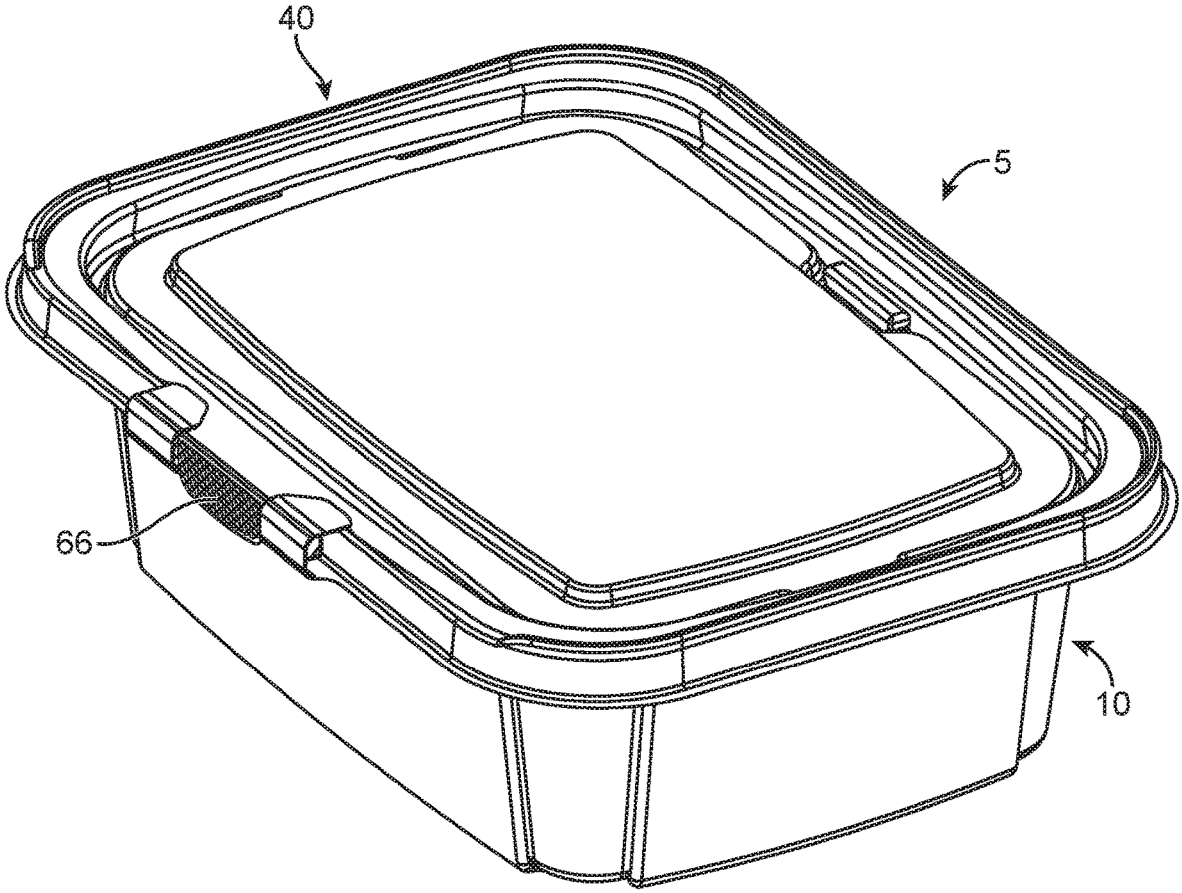
FIG. 1 is a perspective view showing one embodiment of a container with tamper evidence tab in the closed position.

FIG. 1 is a perspective view showing one embodiment of a container 5 having a base 10 and lid 40 with a tamper evidence tab 66 in the closed position.

Figure 2A:
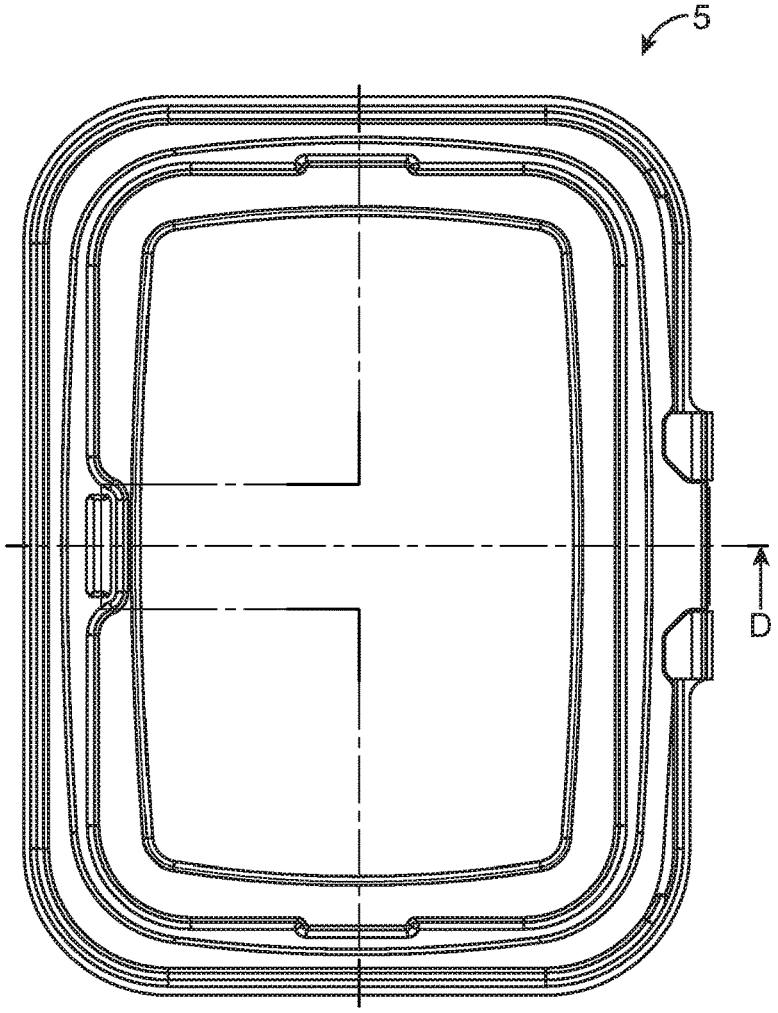
FIGS. 2A-2C are top, front, and side views showing the container of FIG. 1 in a closed position.
Figure 2B:
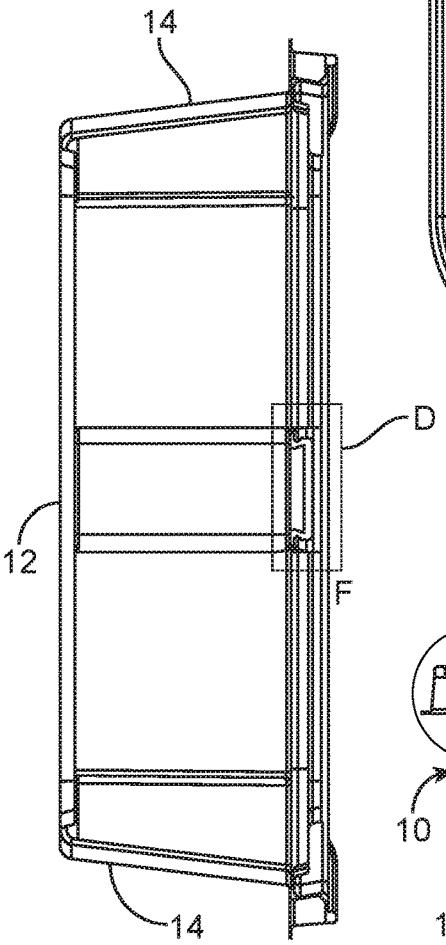
Figure 2C:
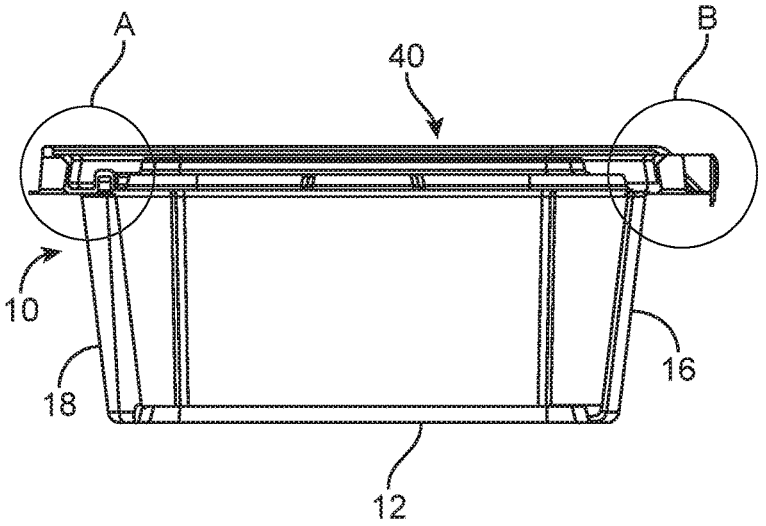
Figure 3A:
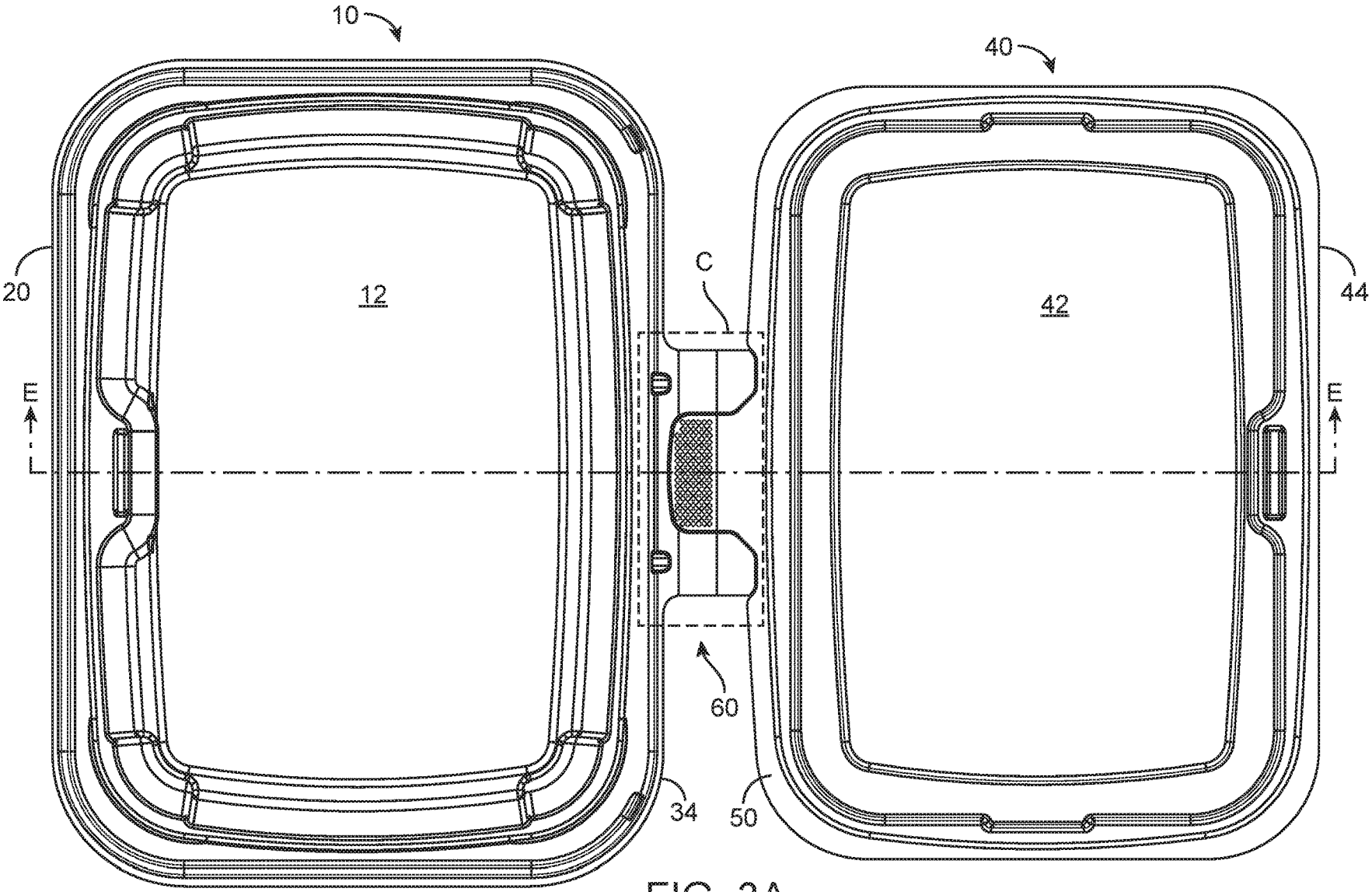
FIGS. 3A-3B are top and side views showing the container of FIG. 1 in an open position.
Figure 3B:
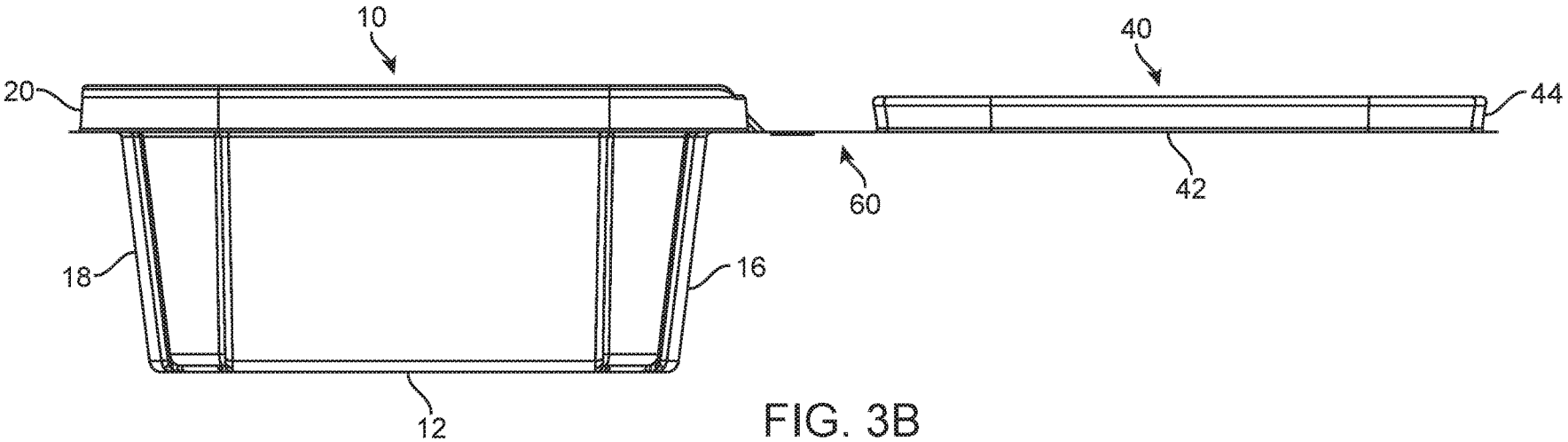

FIGS. 2A-2C are top, front and side views showing the container 5, base 10 and lid 40 in a closed position and FIGS. 3A and 3B are top and side views showing the container 5, base 10 and lid 40 in an open position. The base 10 may be formed in one piece having a bottom 12, substantially upright side walls 14, rear wall 16 and front wall 18 forming a cavity in which a product is placed. The top of the walls form a base edge 20 around the upper periphery of base 10.

Figure 5:
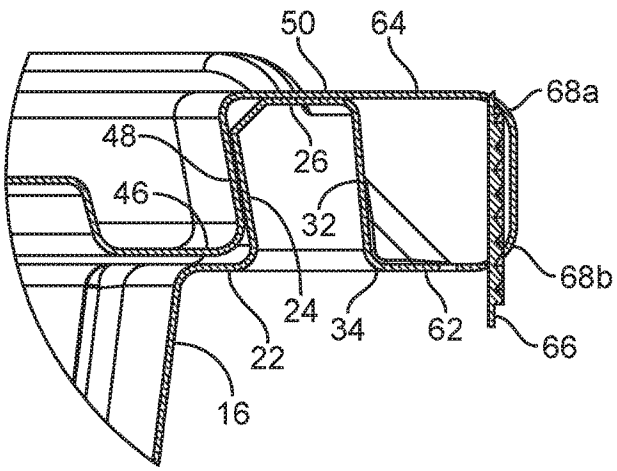
FIG. 5 is a sectional view of the lid and base at B of FIG. 2C.
Figure 4:
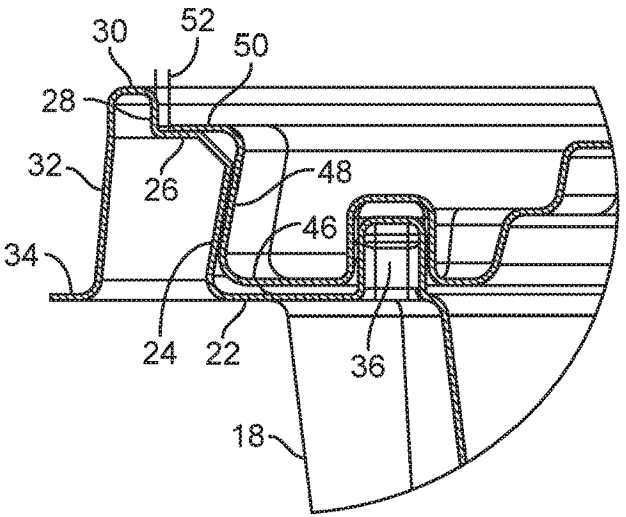
FIG. 4 is a sectional view of the lid and base at C of FIG. 2C.

The base edge 20 includes a lower base flange 22, a lower base flange wall 24, an intermediate base flange 26, an intermediate base flange wall 28, an upper base flange 30 and a base skirt 32, as shown in FIGS. 4 and 5. Lower base flange 22 flares outwardly from side walls 14, rear wall 16 and front wall 18 and extends around the base in a continuous unbroken manner. Lower base flange wall 24 extends upwardly from the lower base flange 22 ending at intermediate base flange 26. In some embodiments, the lower base flange wall 24 is designed to lean inwardly to form an undercut to couple with top 40. Intermediate base flange 26 flares outwardly ending either at upper base flange wall 28 or ending at the downward extending base skirt 32. Intermediate base flange 26 also extends around the base in a continuous unbroken manner. Upper base flange wall 28 is proximate the side walls 14 and front wall 18 and extends upwardly from the intermediate base flange 26, ending at upper base flange 30. Upper base flange 30 flares outwardly ending at the downward extending base skirt 32 having an outwardly flaring lower base lip 34. The lower base lip ending either at an edge 36 or continuing into a flat area 62 which forms part of the hinge 60, shown in FIG. 6.

The lid 40 typically has a shape complementary to that of base 10 in that the overall plan shape would be substantially the same as that of base 10. The lid 40 includes a top lid portion 42 and a lid edge 44. The top lid portion 42 is substantially similar in overall dimensions to bottom 12 and the lid edge 44 includes complementing features to engage the base edge 20, as shown in FIGS. 4 and 5. In the embodiment shown, lid edge 44 includes a lower lid flange 46, a lower lid flange wall 48, an upper lid flange 50.

Lower lid flange 46 flares outwardly from top lid portion 42 and extends around the lid in a continuous unbroken manner. Lower lid flange wall 48 extends upwardly from the lower lid flange 46 ending at upper lid flange 50. In some embodiments, the lower lid flange wall 48 is designed to match and engage lower base flange wall 24 so that the lid 40 is coupled to the base 20. Upper lid flange 50 flares outwardly ending either at a lid edge 52 or continuing into a flat area 64 which forms part of the hinge 60, shown in FIG. 6.

The upper lid flange 50 is planer and is designed to seal against the intermediate base flange 26. The lid edge 52 ends proximate the upper base flange wall 28, so the lid edge 52 sits below the upper base flange 30 and the lid 40 cannot be opened using the lid edge 52.

Figure 6:
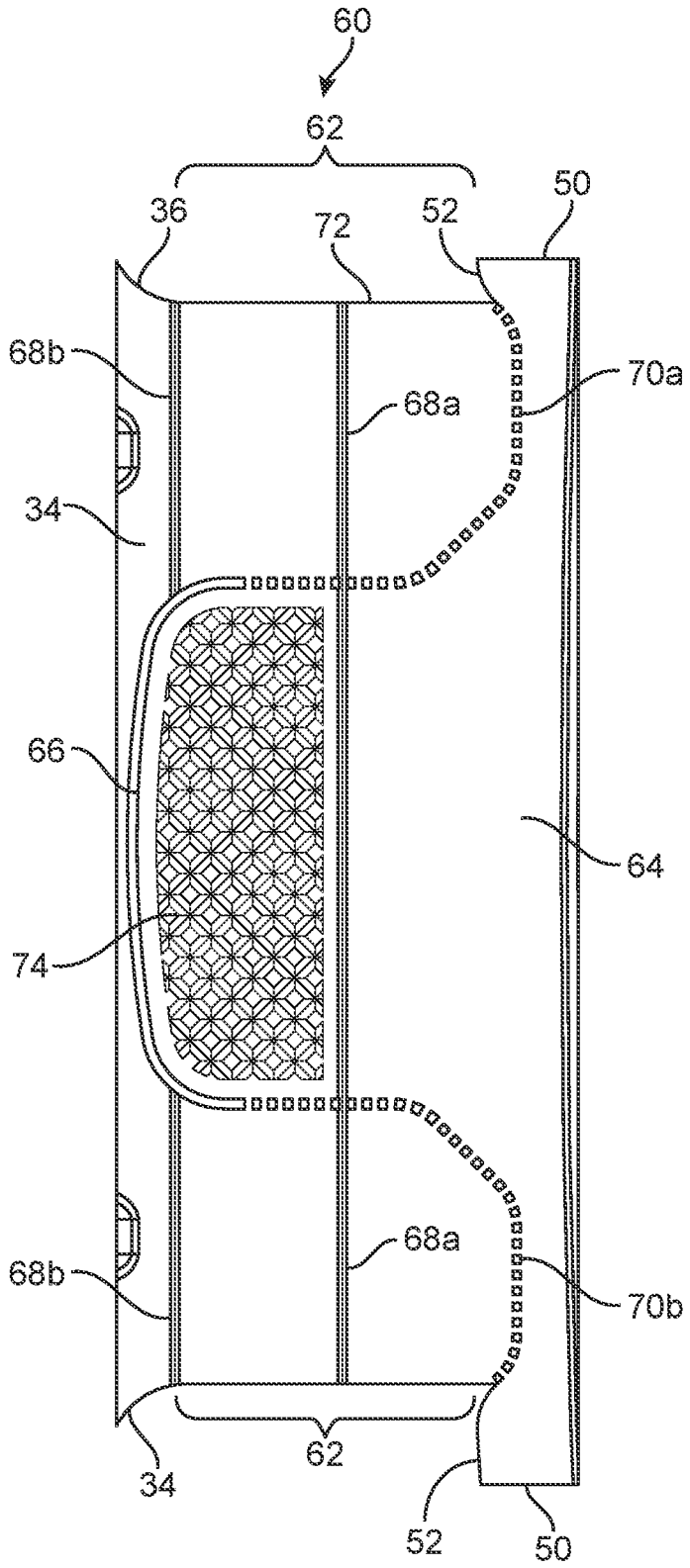
FIG. 6 is an enlarged view at C of FIG. 3A showing details of the tamper evident tab.
Figure 7:
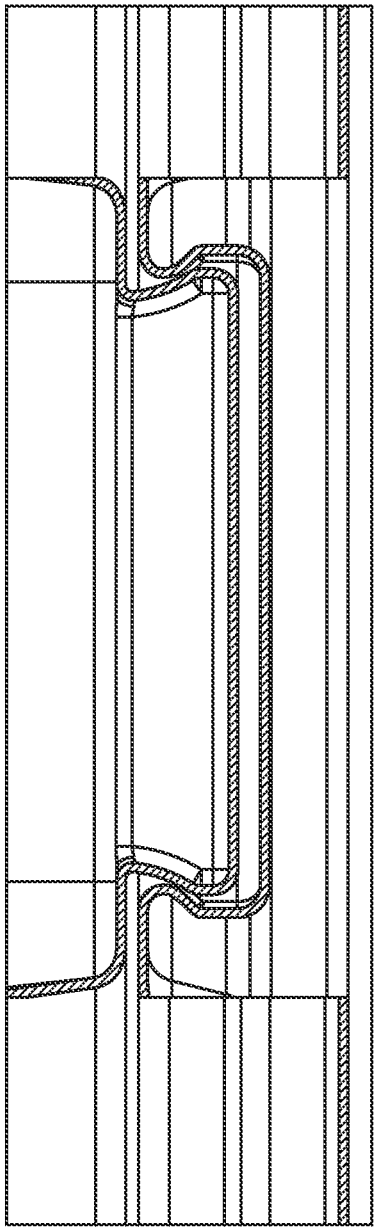
FIG. 7 is a sectional view at D of FIG. 2B.
Figure 8:
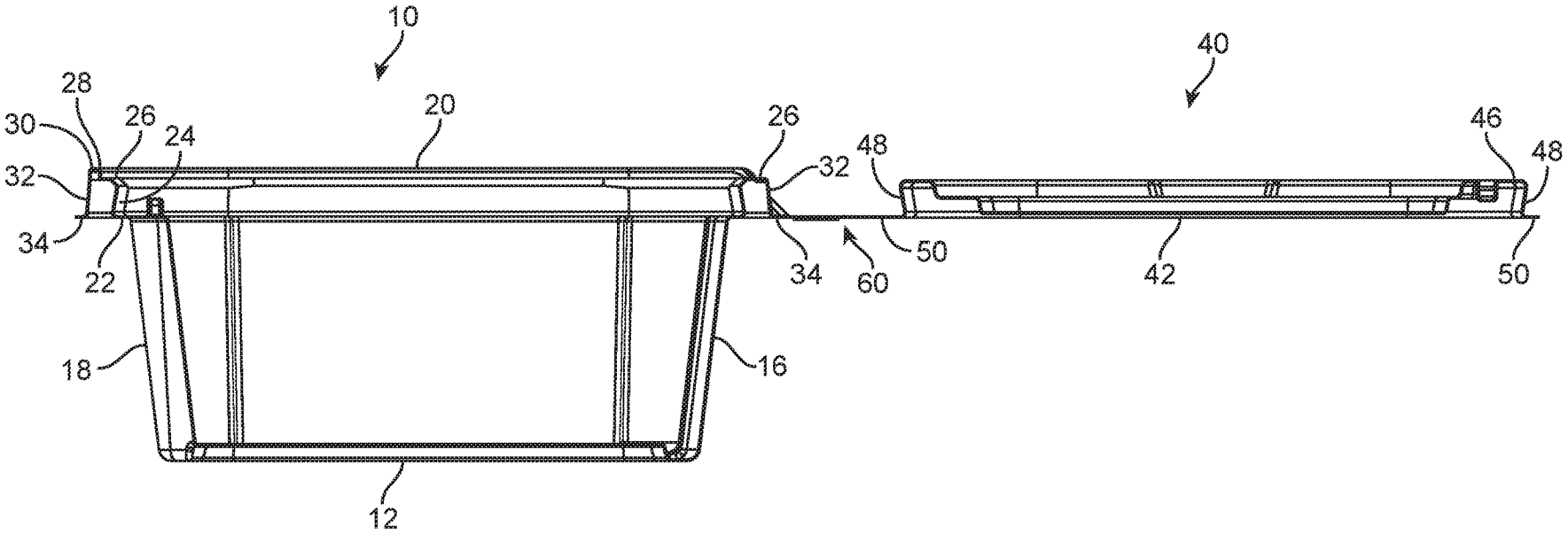
FIG. 8 is a sectional side view taken at E-E of FIG. 3A.

The base 10 and lid 40 are be joined by the flexible hinge 60, shown in FIGS. 3 and 6. The hinge 60 is preferably formed integrally with both base 10 and lid 40 such that the base and lid are a single continuous piece of material formed simultaneously. In the embodiments shown, the hinge 60 hinge is proximate the rear wall 16 so that the lid 40 opens from the front. In other embodiments, the hinge 60 can be positioned on any side of the container.

The hinge 60 includes a base hinge portion 62, a lid hinge portion 64 having a tab 66, and upper and lower hinge lines 68*a* and 68*b*. In the embodiment shown, base hinge portion 62 is an extension of lower base lip 34, and lid hinge portion 64 is extension of lid flange 50. As the lid 40 is folded toward the base 10, the upper and lower hinge lines 68*a* and 68*b* fold, as shown in FIG. 5. The figure also shows that the tab 66 extends downward from the upper hinge line 68*a*. This downward position of the tab 66 allows simple opening of the packaging by pulling the tab 66 away from the package.

The base hinge portion 62 and lid hinge portion 64 are connected along breakable joints 70*a* and 70*b* separated by the tab 66, the breakable joints 70*a* and 70*b* extending from the tab 66 to an outer hinge edge 72. Portions of the tab may include a texture or roughened surface 74 to assist in gripping the tab 66.

When the tab 66 is pulled, the base hinge portion 62 and lid hinge portion 64 are separated or tear along the breakable joints or lines of weakness 70*a* and 70*b*. In the embodiment shown, once the breakable joints 70*a* and 70*b* are separated, the base hinge portion 62 remains with the base 10 and the lid hinge portion 64 remains with the lid 40. This is an indication that the lid has been tampered with and/or opened.

The various embodiments of the base and lid may be manufactured of any type of suitable plastic such as polystyrene or polyethylene, rubber, or any other suitable material. These materials may be opaque, clear or translucent, and the material of construction may be colored by pigments or any type of dye. The manufacturing techniques may be any conventional method, including injection molding, blow molding, thermoforming or vacuum molding techniques. In some embodiments that base may also include pleats.

While embodiments and applications of this invention have been shown and described, it would be apparent to those skilled in the art that many more modifications than mentioned above are possible without departing from the inventive concepts herein. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A tamper-resistant container comprising:

a base;

a lid coupled to the base;

a flexible hinge having a base hinge portion and a lid hinge portion with a tamper evidence tab, and upper and lower hinge lines;

a line of weakness coupled to the tamper evidence tab connecting the lid hinge portion and the base hinge portion;

wherein when the lid is folded toward the base, the upper and lower hinge lines fold and the tamper evidence tab extends in a downward direction from the upper hinge line, wherein the downward position of the tamper evidence tab allows opening of the container by pulling the tamper evidence tab away from the package to separate the flexible hinge along the lines of weakness showing evidence of tampering.

2. The container of claim 1, wherein separating the hinge along the lines of weakness results in separation of the lid from the base.

3. The container of claim 1, wherein the base includes upright side walls, rear wall and front wall and a bottom forming a cavity.

4. The container of claim 1, wherein the base includes a base edge, and the lid includes a lid edge being configured to couple with the base edge in a closed position.

5. The container of claim 1, wherein the flexible hinge consists of a flat area in the open position.

6. The container of claim 5, wherein the tamper evidence tab is coupled with lines of weakness from the tamper evidence tab to outer edges of the flat area.

7. The container of claim 1, wherein the hinge is preferably formed integrally with both base and lid such that the base and lid are a single continuous piece of material formed simultaneously.

8. The container of claim 1, wherein the hinge is proximate a rear wall.

9. The container of claim 1, wherein a lid edge sits below a base edge so that the lid cannot be opened using the lid edge.

10. A container having a tamper evidence tab comprising:

a base having a base edge;

a lid having a lid edge, the lid edge being configured to couple with the base edge in a closed position;

the base edge and lid edge are hingedly connected to each other via a flexible hinge, wherein the flexible hinge consists of a base hinge portion and a lid hinge portion, and upper and lower hinge lines and is a flat area in the open position, the flexible hinge having a substantially U-shaped tamper evidence tab extending in a downward position from the upper hinge line and coupled with lines of weakness from the tamper evidence tab to outer edges of the flat area, so that when the downward tamper evidence tab is grasped and pulled away from the package showing evidence of tampering, the lines of weakness between the base edge and lid edge are torn allowing opening of the lid.

11. The container of claim 10, wherein the base includes upright side walls, rear wall and front wall and a bottom forming a cavity.

12. The container of claim 10, wherein the lid edge sits below the base edge so that the lid cannot be opened using the lid edge.

13. A tamper-resistant container comprising:

a base having upright side walls, rear wall and front wall extending between a bottom and base edge forming a cavity;

a lid having a top lid portion and a lid edge, the lid edge configured to couple with the base edge in a closed position;

the base and lid are hingedly connected to each other via a flexible hinge, wherein the hinge consists of a base hinge portion and a lid hinge portion, and upper and lower hinge lines and is a flat area in the open position, the hinge having a substantially U-shaped tamper evidence tab coupled with lines of weakness from the tamper evidence tab to an outer edge of the flat portion, so that when closing the plastic lid the tamper evidence tab extends in a downward position from the upper hinge line which can be grasped and pulled away from the package showing evidence of tampering for opening the lid.

14. The container of claim 13, wherein the lid edge sits below the base edge so that the lid cannot be opened using the lid edge.

* * * * *